US006286975B1

(12) United States Patent
Rodgers

(10) Patent No.: US 6,286,975 B1
(45) **Date of Patent: *Sep. 11, 2001**

(54) ACCELERATION RESPONSIVE ILLUMINATED FOOTWEAR SWITCH WITH RANDOM OUTPUT

(76) Inventor: Nicholas A. Rodgers, c/o Shaw & Co., SJO 892, P.O. Box 025216, Miami, FL (US) 33102-5216

( * ) Notice: Subject to any disclaimer, the term of this patent is extended or adjusted under 35 U.S.C. 154(b) by 0 days.

This patent is subject to a terminal disclaimer.

(21) Appl. No.: 09/621,346

(22) Filed: Jul. 21, 2000

Related U.S. Application Data

(63) Continuation of application No. 09/081,667, filed on May 20, 1998, now Pat. No. 6,164,794, which is a continuation-in-part of application No. 08/969,307, filed on Nov. 13, 1997, now abandoned.

(51) Int. Cl.[7] ..... H01H 1/26

(52) U.S. Cl. ..... 362/103; 362/227; 362/236; 362/276; 362/184; 200/6 R; 200/61.45 R

(58) Field of Search ..... 362/800, 802, 362/103, 184, 227, 236, 276; 200/1 R, 5 R–8 R, 9, 49, 52 R, 61.09, 61.45 R, 61.48, 61.49, 79, 68

(56) References Cited

U.S. PATENT DOCUMENTS 5,469,132 * 11/1995 Lam ..... 340/392.1
5,599,088 * 2/1997 Chien ..... 362/103

* cited by examiner

*Primary Examiner*—Thomas M. Sember
*Assistant Examiner*—Ismael Negron
(74) *Attorney, Agent, or Firm*—Robert L. Westell

(57) ABSTRACT

Illuminated shoes are provided with a switch having a fixed end for connection to one side of a battery and a movable end for contacting one of a plurality of selectable conducting members each connected to a separate terminal of a sub-circuit. Each sub-circuit contains a source of light or sound with a common terminal at the opposite end from the separate terminal and connected to the other side of said battery. The switch movable end moves substantially randomly or in random patterns under inertia to contact a conducting member to complete a sub-circuit.

5 Claims, 6 Drawing Sheets

ACCELERATION RESPONSIVE ILLUMINATED FOOTWEAR SWITCH WITH RANDOM OUTPUT

This is a continuation of application 09/081,667 filed May 20, 1998 now U.S. Pat. No. 6,164,794, which is a continuation-in-part of application 08/969,307 filed Nov. 13, 1997 now abandoned.

FIELD OF THE INVENTION

This invention relates to means for creating light or sound during the motion of a shoe. 'Acceleration' includes deceleration herein.

DESCRIPTION OF THE RELATED ART

The closest prior art known to the applicant is represented by the U.S. Pat. No. 5,408,764 dated Apr. 25, 1995 to, WUT, Siu B. and U.S. Pat. No. 5,599,088 to CHIEN, Tseng L. Both show means for providing light sources for LED's which use inertially activated contact springs responsive to acceleration of the shoe to intermittently close the circuit to and illuminate the light sources. In such prior art patents the light source or sources illuminated with each switch closure are the same each time they come on.

BRIEF SUMMARY OF THE INVENTION

It is an object of this invention to provide a switch closable to connect one or two of a plurality of sub-circuits, said switch having a fixed end for connected to one side of a battery and movable end to contact one plurality of selectable conducting members, each member for respective connection to the separate contact of a different sub-circuits on contact by the movable end of said switch. A sub-circuit contains a source of light or sound and in a common terminal remote from the conducting member, is connected to the other side of said battery.

The preferred circuit therefore comprises: a battery connected on one side to fixed end of a switch member and on the other side connected to a common terminal for the sub-circuits. If the sources in sub-circuits have a polarity (such as LED's) then they must conform to the battery polarity.

Although, for completeness, sources are spoken of as 'light or sound', a high proportion are light, since this is thought to produce a better effect with random activation. The light source will usually be an LED since this gives the best intensity relative to the voltage required.

Thus a shoe or boot will have the switch mounted to have its movable end vibrate therein and each time a conducting member is contacted by the switch movable end, the sub-circuit corresponding to the contacted conducting member will provide a light or sound output. The light will be sustained for the duration of the 'dwell time', being the interval of contact between conducting member and the switch movable terminal contacting it. Thereafter the resilience of the spring will move the movable end out of contact with the formerly contacted conducting member.

Given the switch design, the next contact of a conducting member by the movable end of the switch is usually a different member. Given the substantially random pattern of switch movable end movement, the lights will appear randomly or sound is heard randomly or in random patterns at various locations on the shoe for novel and striking effects.

'Source' refers to a source of light or sound although the more striking effects are thought to occur with light sources.

One sub-circuit may use a completely different source or sources from another, but may also use a different combination of sources. For example a shoe with two LED's (sources A and B) may have three sub-circuits, containing respectively: source A, source B and sources A and B.

Preferably the switch will be mounted in the shoe with the longitudinal axis of the resilient stem approximately vertical, in the most common attitude of the switch. The bending stresses are in the resilient extent between the movable and fixed end and the largest one those about a horizontal axis and switch failure is thought to be reduced. Switch failure will often cause battery failure if there is a continued drain on the battery.

It is a feature of one facet of the invention that it is desirable to have variable dwell times that is a variable length of contact between the movable and a conducting member. This results in corresponding varying length of energization of the light or sound system activated during the dwell interval. A preferred way of accomplish thus, when the movable contacts are formed in a general circular ring about the switch stem, is to curve the conducting members so that their ends corresponding to the movable end are curving away from its rest position. Another preferred way is to shape the conducting member to be convex in section perpendicular to the longitudinal extent of the stem so that the movable contact again tends to move for varying distances along the convex surface extending the dwell time. Thus any surface, convex toward the movable contact will tend to produce variable dwell times as the surface is non-normal to the direction of the moving contact. Variable and sometimes extended dwell times are also obtainable with conducting members concave toward the stem. However the problems of construction are much greater. The switch being discussed will often be 7 mm high and about 7 mm wide to fit in a shoe and this limits design flexibility. Other means of extending dwell time are considered within the scope of the invention such as making the conducting member contact areas of a softer mechanical resistance but this is difficult within the scale provided and also it is noted that the design must be such as to avoid the risk of tangling.

BRIEF DESCRIPTION OF SEVERAL VIEWS OF THE DRAWINGS

In drawings which illustrate a preferred embodiment of the invention:

FIGS. 18 and 19 indicate the means for attaching and connecting the spring.

DETAILED DESCRIPTION OF THE INVENTION

Figure 1:
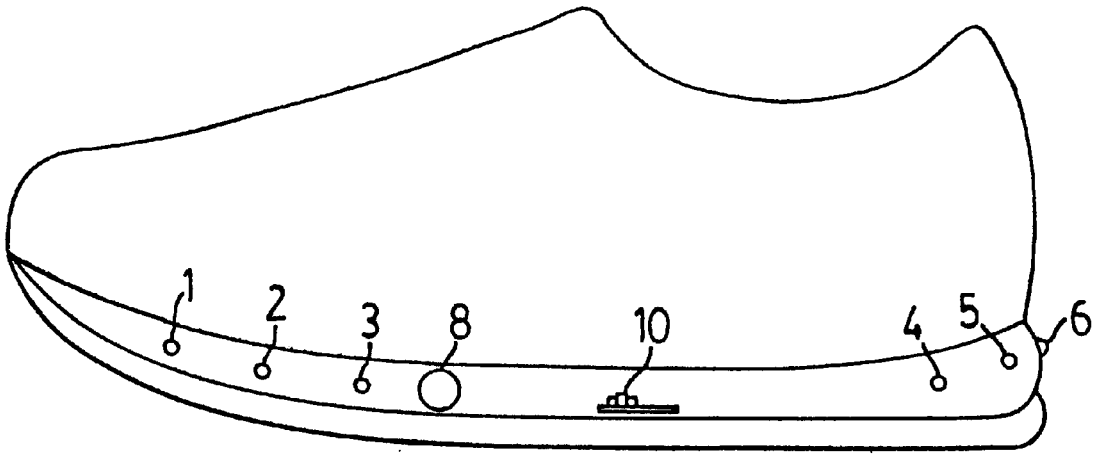
FIG. 1 is a somewhat schematic side view of a shoe in accord with the invention.
Figure 2:
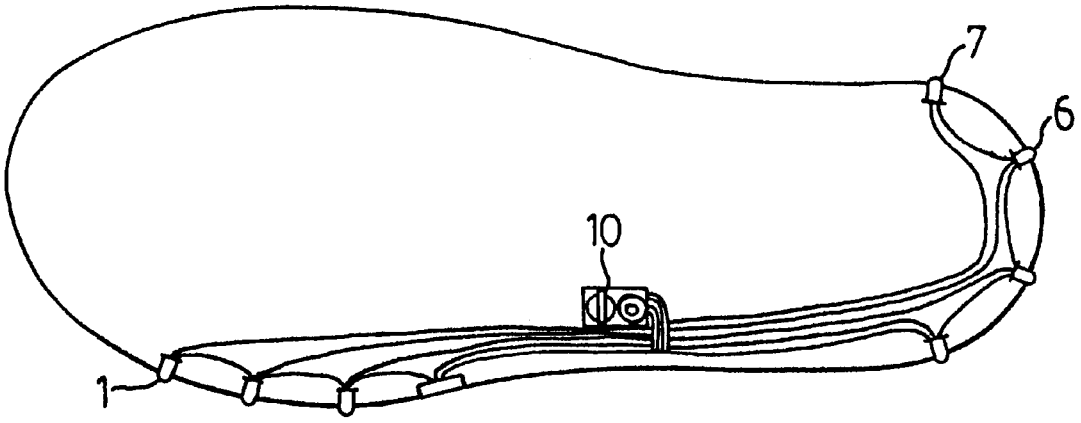
FIG. 2 is a plan view with parts of the shoe removed to show the location of the circuit elements.
Figure 3:
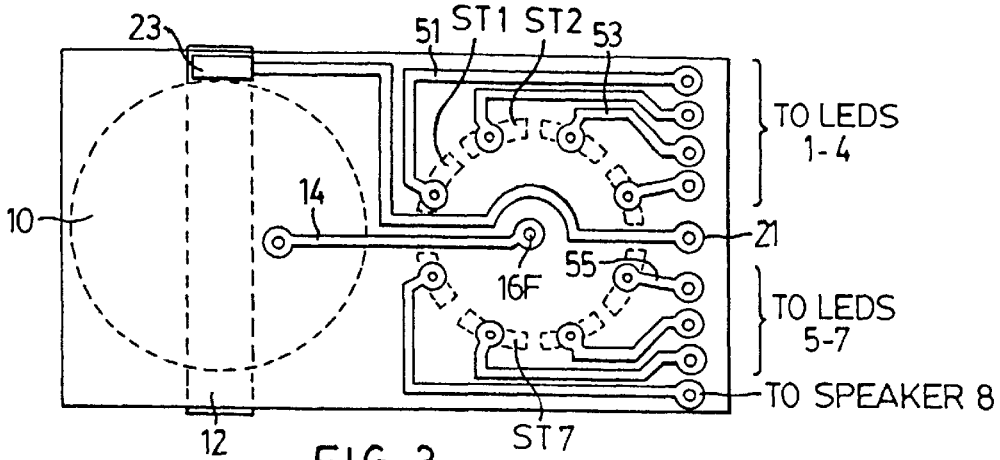
FIG. 3 shows a printed circuit board with the battery.

In the drawings FIGS. 1 and 2 show a running shoe having seven LED's 1, 2, . . . 7 and one sound source speaker 8. FIG. 3 shows a printed circuit board ('PCB') with battery 10, battery clip 12 and conducting trace 14 to the fixed end 16F of switch 16, and movable end 18 at the free end of stem 19 formed by a helical spring and traces S1 to S8 connected to common negative 21 (FIG. 4) (not shown in FIG. 3 since it is on the back of the PCB), which common negative is connected to the battery negative 23.

The circuit arrangement is shown in 4 indicating that the connected traces S1–S7 are LED—containing while trace S8 is connected to the speaker circuit.

Figure 5:
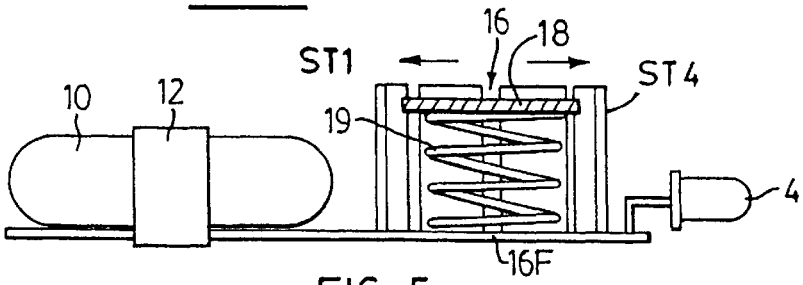
FIG. 5 and 6 are side view and plan respectively for the device.
Figure 6:
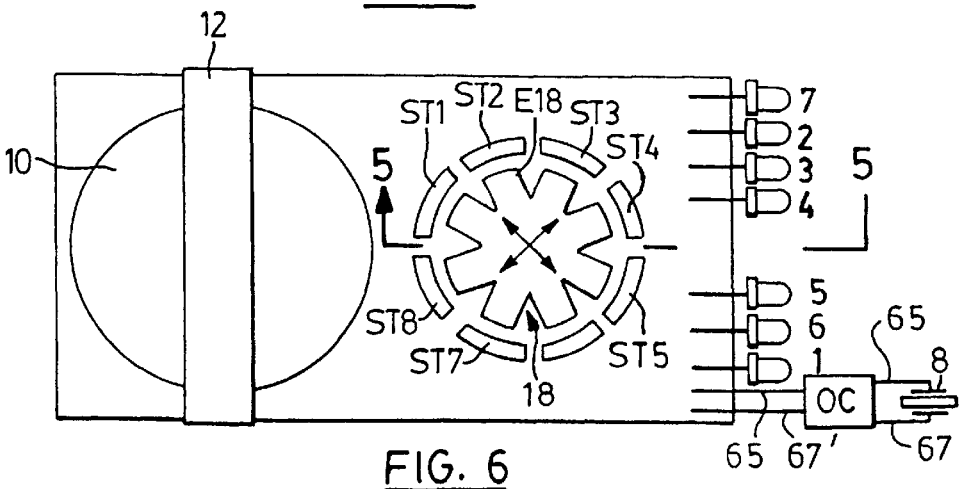

FIGS. 5 and 6 show the preferred arrangement of the selection switch.

Figure 4:
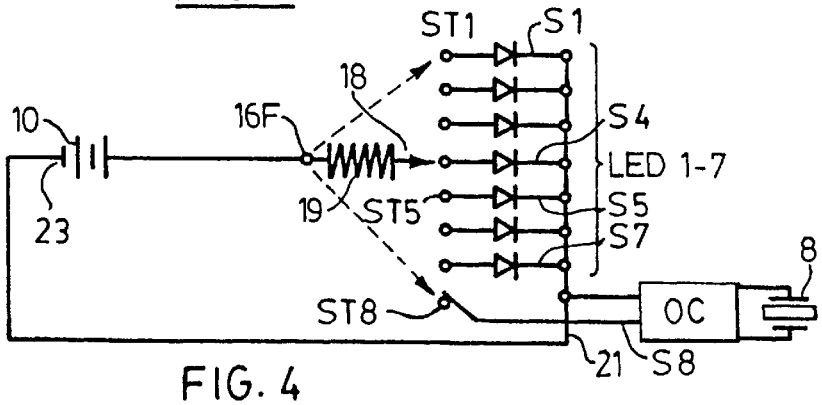
FIG. 4 is a schematic circuit for the device of FIGS. 5 and 6.

The selective contacts ST1–ST8 respectively connected to traces or sub-circuits S1–S8 are preferably in the form of arcuate conducting plates upstanding from the PCB shown in FIGS. 5 and 6 and connected as shown in FIGS. 3 and 4. Between the plates is the helical spring 19 whose axis is usually centred in the ring defined by ST1 –ST8 here whose end defines eight 'strike' points E18. The terminal stem 19 formed by 9 helical spring and its movable end terminal 18 are preferably designed to deflect due to acceleration and their inertia in a random azimuthal direction and to contact one of the contacts ST1–ST8. Each contact ST1–ST8 thus corresponds to a sub-circuit.

Thus, in accord with the randomly selected contact ST1–ST8 an LED is lit or the speaker 8 activated for the duration of the dwell time of the movable end 18 on the conducting member from ST1–ST8. As the shoe continues to move the movable switch end 18 will vibrate over a locus and strike a successive number of conducting members so that corresponding sources of light or sound are lit or sounded.

Although the embodiment shows a separate source for each sub-circuit, it will be obvious that a sub-circuit could have two or more sources in it (usually in parallel) and two sub-circuits could use the same source.

Figure 8:
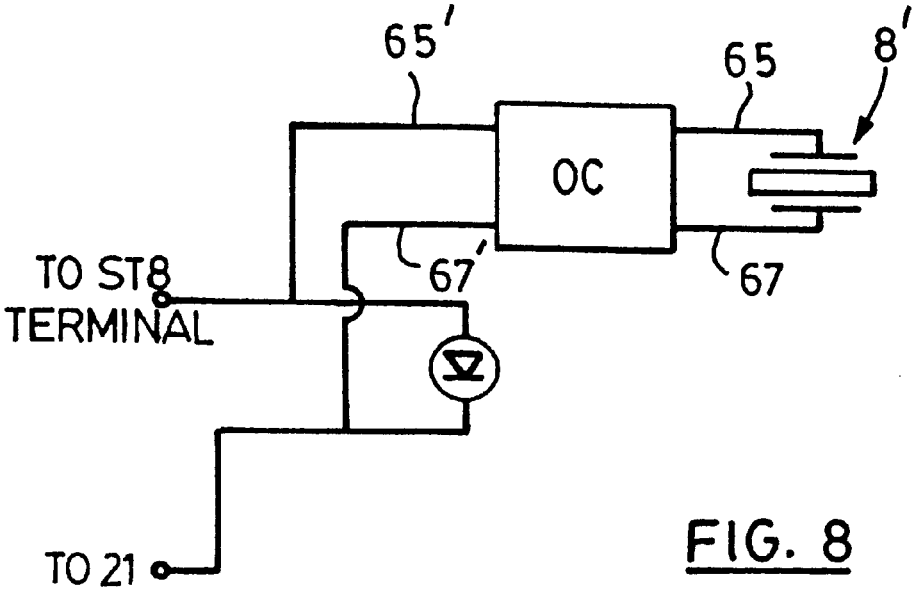
FIG. 8 shows a circuit with speaker and LED.
Figure 9:
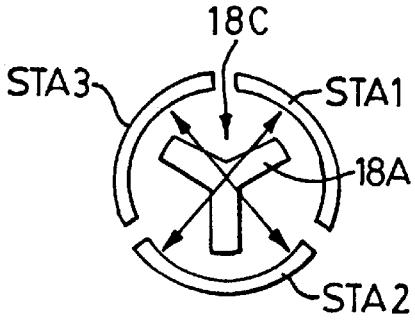
FIG. 9 shows a switch with three selections.
Figure 10:
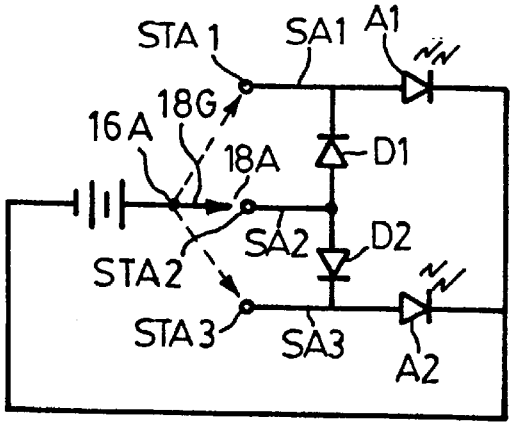
FIG. 10 shows a circuit using the switch of FIG9.

Thus a source may be part of two or more sub-circuits. This is demonstrated in FIGS. 9 and 10. FIG. 9 shows a flexible stem 18C with a moving end vibratable over 360° of azimuthal directions and whose movable end 18A loci include three terminals STA1, STA2, STA3 connected respectively to circuits SA1, SA2, SA3. It will readily be seen that electrical connection of 18A to STA1, STA2 or STA3 will light LED's A1 or A2 respectively. Electrical connection of 18A with STA2 will cause battery currents to flow through (ordinary) diodes D1 and D2 lighting both LED's A1 and A2. Thus two LED's: A1 and A2 provide three sub-circuits each differently constituted. The same logic would provide different combinations of LED's or LED's and speakers. FIG. 8 demonstrates a sub-circuit where an LED and a speaker 8 are connected in parallel in a sub-circuit. FIGS. 4 and 6 show that the speaker 8 is connected to ST8 and to the power source through the oscillator chip OC. The speaker is preferably of the piezotronic type as hereinafter described. The preferred oscillator chip OC is hereinafter described. The chip OC is omitted from FIG. 5 because of where the section is taken. FIG. 8 shows an alternate form of the oscillator circuit which contains an LED in parallel with an oscillator chip OC so that both will be energized simultaneously.

Figure 12:
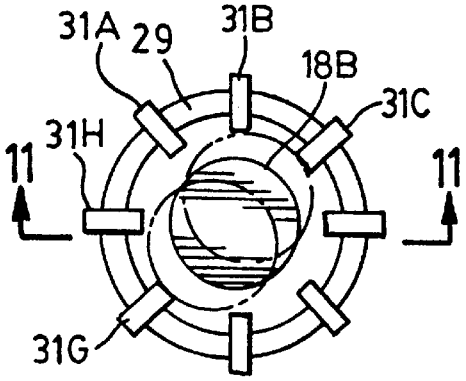
FIG. 12 is a top view of the switch of FIG. 11.
Figure 11:
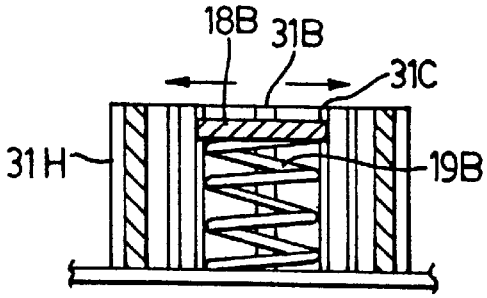
FIG. 11 shows the vertical section of a switch which is an alternate to that of FIGS. 5 and 6 although for the same purposes.

It is thus seen that LED's (or other sources), may be connected in more than one sub-circuit and that, for example, the boot of FIGS. 1 and 2 could have had a sub-circuit in which simultaneously allowed all the lights to be lit. In fact the only limits on the number of sub-circuits or the variety is expense and the physical capacity of the shoe or boot. FIGS. 11 and 12 show a flexible center stem switch wherein a cylindrical shell 29 of plastic is mounted on the PCB on a vertical axis while the movable switch end 18B on a resiliently flexible conducting stem 19B is centred in the cylinder. Each selective conducting member 31A–31H of which eight are shown, is a metal ridge and connector mounted on the cylinder, shaped and arranged to connect at contact member 31A to 31H to a different sub-circuit (not shown) on the PCB. In fact the electrical connections for contacts 31 may be respectively the same as those for the contacts ST1 to ST8, in FIGS. 3–6.

In the alternative of the invention shown in FIGS. 11 and 12 it will be noted that the movable end 18B may strike a single conducting member, here e.g. 31G or may strike two conducting members, say 31B and 31C, simultaneously; in the latter event, simultaneously energizing two sub-circuits.

Given that the movable contact 18B preferably has a stem 19B movable over 360° of azimuthal direction the physical form of the conducting members does not matter, so long as they are located within the locus of movement of the movable switch end during vibrations.

Figure 7:
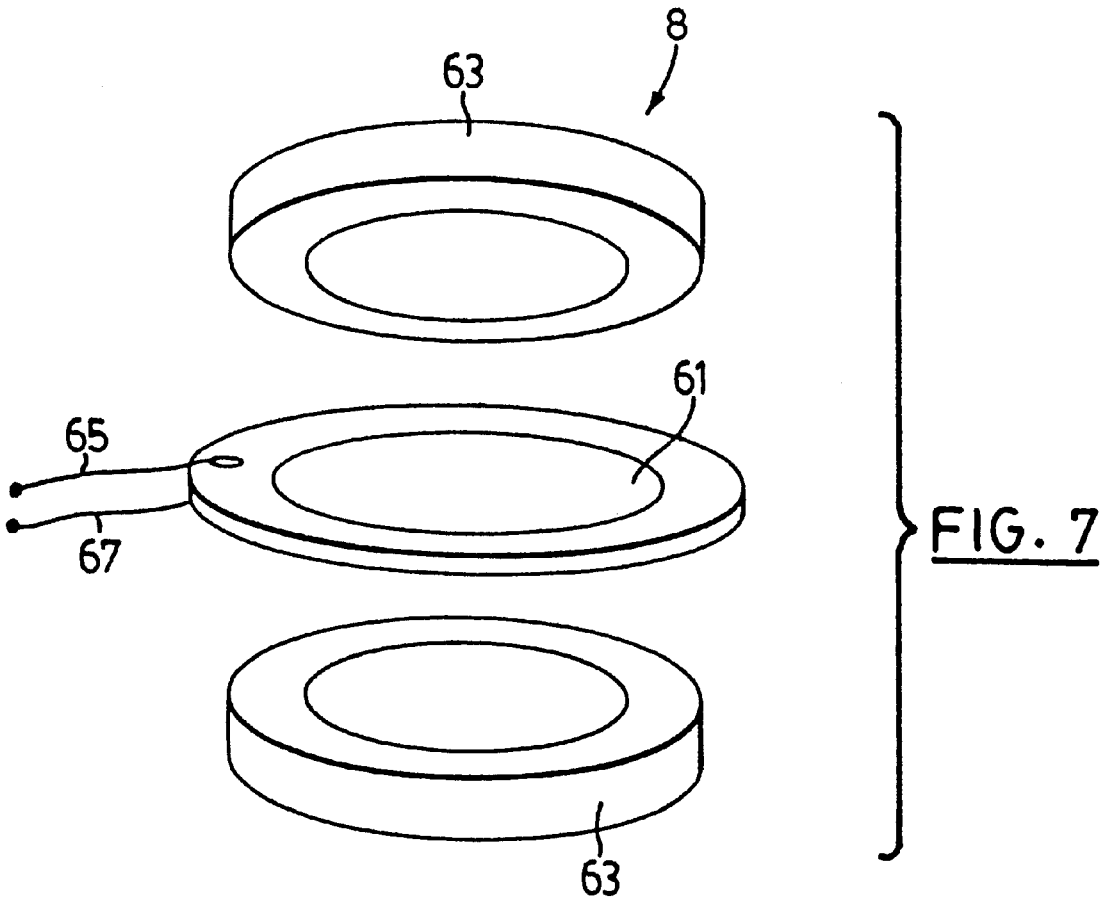
FIG. 7 shows a piezotronic speaker.

FIGS. 7 and 8 show a piezotronic speaker 8' where leads 65, 67 from the oscillator chip connect on opposite sides of the piezotronic diaphragm 61 which vibrates in accord with the voltages received from the oscillator chip OC. Plastic panels 63 on each side of the diaphragm protect it without interfering with sound transmission from the diaphragm.

Figure 13:
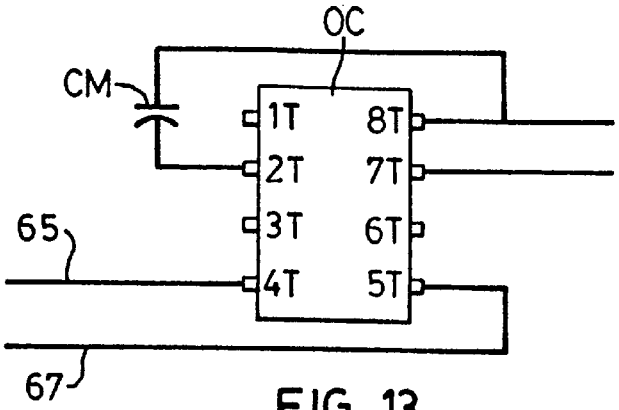
FIG. 13 shows a preferred oscillator chip.

The speaker 8' may be actuated to give the desired note by any suitable oscillator. I prefer to use the oscillator chip OC which preferably comprises a National Semi-Conductor Chip 3909 connected as shown in FIG. 13 as an oscillator.

The basic multi-vibrator circuit of oscillator OC is modified by the capacitor CM to produce the desired sound frequency.

The speaker 8 or 8' may be replaced by a sound synthesizer.

When power appears at the leads 65' and 67' due to the dwell of the end terminal 18 on contact ST8, a quartz crystal in chip OC vibrates to cause power to be applied periodically (as selected) to the chip inputs 65, 67. The rate of vibration and hence the tone can be varied by changing the value of capacitor CM connected between terminals 2T and 8T of chip OC (FIG. 13).

Figure 16:
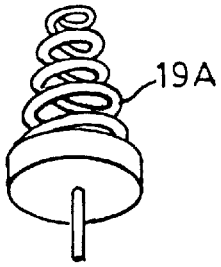
FIG. 16 shows a spring (movable contact) for the switch of FIGS. 14 and 15.
Figure 17:
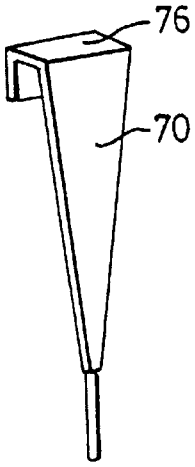
FIG. 17 shows a preferred form for the conducting member and FIG. 18 shows the preferred 'form or basket' for holding the conducting members.
Figure 18:
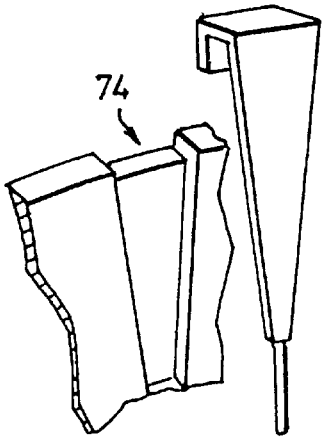

Before introducing improved variable dwell models, it is desired to review the general approach, taken herein to the circuitry already described in FIGS. 3–6 and 9–10. A switch, in accord with the invention, permits, under vibration electrical contact with one of a plurality of conducting members. Each conducting member is connected to one separate terminal of a sub-circuit. The sub-circuit will normally contain a source for emitting light or sound when the circuit conducts. The other respective terminals of the plurality of sub-circuits are connected to a common terminal, see for example 16F in FIGS. 3 and 4 and 16A in FIG. 10 The movable switch end is connected to one side of the battery while the other side of the battery is connected to the common terminal of the sub-circuits.

Thus the light or sound source is visible or audible for the duration of contact between the movable switch end and the respective conducting member, i.e. the 'dwell time'.

There is hereafter discussed switch variations wherein the dwell time varies to a greater degree than with the embodiments shown in FIGS. 1–13.

Figure 14:
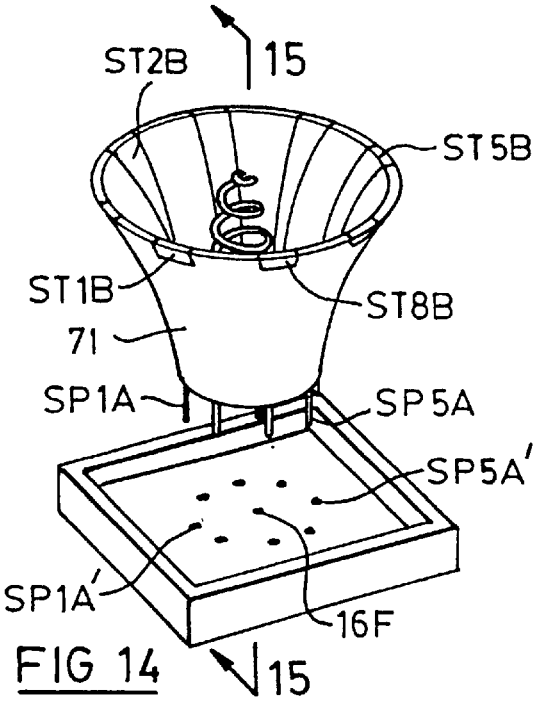
FIG. 14 shows in perspective.
Figure 15:
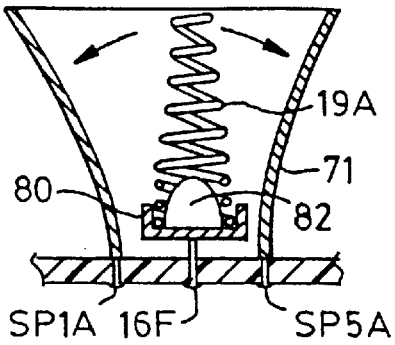
FIG. 15 shows in vertical section a novel form of the switch for achieving variable dwell times.

In FIGS. 14 and 15, in the plastic basket or surface of revolution 71, the conducting members ST1B, ST2B, . . . ST8B are curved outwardly when viewed in vertical sections to resemble sections of a horn of a trumpet. Preferably these conducting members are shaped so that their main body 70 rides in complementary grooves in the 'basket' 71 which, with the eight main bodies 70 filling the respective grooves, presents a substantially smooth surface of revolution facing the spring 19A. The spring 19A may be a helix of slightly decreasing diameter, with height. The upper ends of the bodies 70 have bent over portions 76 to the upper edge of the basket, which is crenellated at areas 74 for this purpose. The bodies 70 preferably taper downwardly, as shown, to reach the eight spindles 1A, 2A . . . 8A which seat in sockets SP1A, SP2A . . . SP8A which connect to the light or sound circuits not shown. Because of the curve in the conducting members, there tends to be a 'wrapping' effect of the spring about the convex inward shape presented to it. This in some cases will increase the dwell time, and, at times will create a wider variation of the dwell time. A variation in the dwell time could also have been obtained by a concave inward shaped conducting member. However the cost of construction would, it is thought, be higher than desired.

Figure 19:
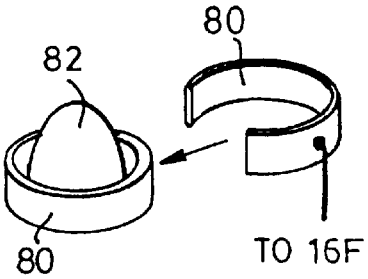
Figure 20:
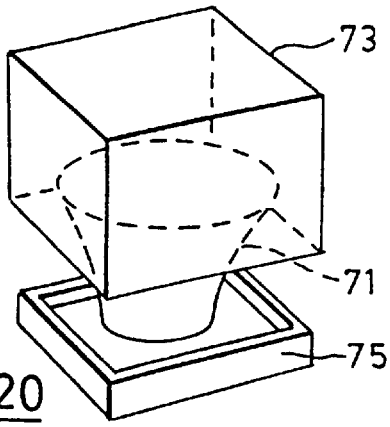
FIG. 20 shows a housing for the switch in accord with the invention.

A preferred method of constructing the spring is shown in FIGS. 19 and 15 where a metal clamp 80 which may be electrically connected to terminal 16F, is fitted about the dome 82 and may be attached to the lower one or two turn spring by soldering or the like. FIG. 20 shows a casing for the basket 71 where the cover 73 makes a friction fit with the base 75. The base 75 may be made small and the sub-circuits located elsewhere.

Figure 21:
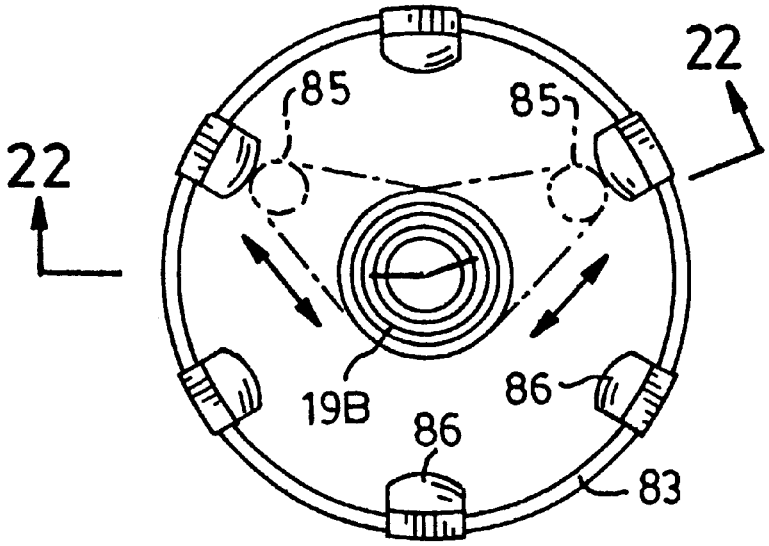
FIG. 21 shows an alternate form of switch in plan view.
Figure 22:
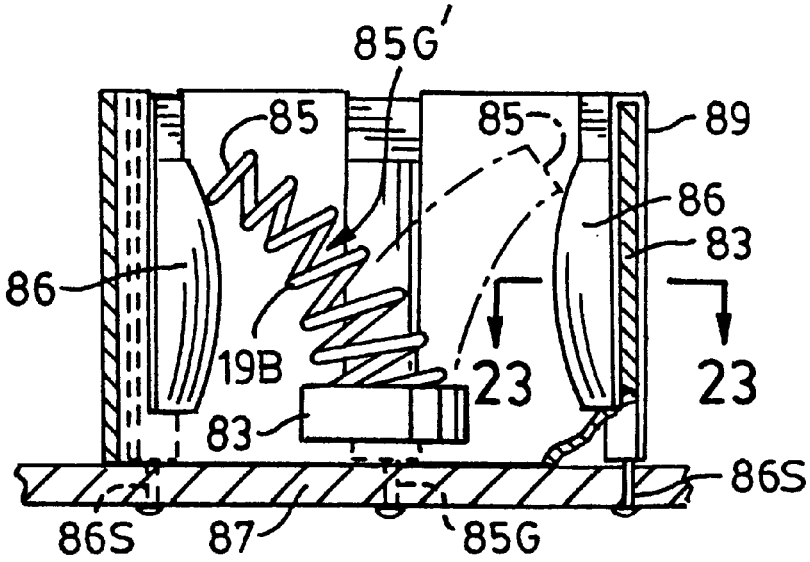
FIG. 22 shows the alternate form of switch in side view.
Figure 23:
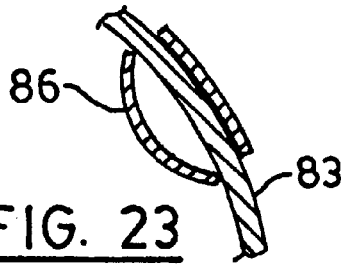
FIG. 23 shows a section along the lines 23—23 of FIG. 22.

In the alternative of FIGS. 21, 22 and 23 the switch contains a cylindrical holder 83 with the conducting members shaped to form conducting members 86 which are convex toward the movable switch end 85 in horizontal section (FIG. 21). The movable switch end 85 is the free end of the helical spring 19B which is shaped like the spring 19A of FIG. 15. The stem 85G is connected to one side of the battery (not shown). The conducting members 86 are each connected over a spindle 86S in platform 87 to the respective individual terminals of sub-circuits (not shown) but whose common terminal (similar to 16F) is connected to the other side of the battery.

On the holder 83 the outer extents 89 of the conducting members may be connected to the spindles 86S, as shown or the inner ends connected to the spindle 86S as are the conducting members of the variant in FIG. 15.

In the embodiments of FIGS. 14 to FIG. 20 and FIGS. 21–25 the conducting members often are met by the moving switch end 85 with a glancing or non-normal impact, which tends to create widely varying dwell times which are sometimes short and sometimes sustained.

I claim:

1. A switch comprising a resilient stem of electrical conducting material having a fixed and a movable portion, said stem mounted with the longitudinal axis approximately vertical in the most common attitude of the switch, said movable portion being resiliently deflectable from rest position to contact one of a plurality of conducting members, at least some of said plurality being shaped to create a variable dwell time depending on an area of contact between said movable position and the corresponding conducting members at said area of contact.

2. A switch as claimed in claim 1 wherein said conducting members are shaped to receive contact from said movable portion at angles non-normal to a surface of said conducting members at said area of contact.

3. A switch as claimed in claim 1 wherein a plurality of said conducting members are convex toward said movable portion.

4. A switch as claimed in claim 1 wherein said stem at rest defines a longitudinal direction, and wherein a surface of a plurality of said conducting members include a component in said longitudinal direction and extents curving away from said movable portion.

5. A switch as claimed in claim 1 in which said plurality of conducting members are arranged in a ring about said stem in a rest position, said plurality of conducting members extending from a base member adjacent said fixed end and curving away from said stem to increase the distance from said movable portion.

* * * * *